US009242791B2

(12) United States Patent
Denisart et al.

(10) Patent No.: US 9,242,791 B2
(45) Date of Patent: Jan. 26, 2016

(54) CAPSULE FOR PREPARING AND DELIVERING A DRINK BY INJECTING A PRESSURIZED FLUID INTO THE CAPSULE

(75) Inventors: Jean-Paul Denisart, La Conversion (CH); Jean-Luc Denisart, Cully (CH); Zenon Ioannis Mandralis, Chexbres (CH); Abdelmalek Benelmouffok, Nyon (CH); Thomas Kaeser, Brent (CH)

(73) Assignee: Nestec S.A., Vevey (CH)

( * ) Notice: Subject to any disclaimer, the term of this patent is extended or adjusted under 35 U.S.C. 154(b) by 2830 days.

(21) Appl. No.: 11/574,054

(22) PCT Filed: Aug. 22, 2005

(86) PCT No.: PCT/EP2005/009055
§ 371 (c)(1),
(2), (4) Date: Apr. 13, 2009

(87) PCT Pub. No.: WO2006/021405
PCT Pub. Date: Mar. 2, 2006

(65) Prior Publication Data

US 2009/0211458 A1 Aug. 27, 2009

(30) Foreign Application Priority Data

Aug. 23, 2004 (EP) ..... 04019930

(51) Int. Cl.
*B65D 85/804* (2006.01)

(52) U.S. Cl.
CPC ..... *B65D 85/8043* (2013.01)

(58) Field of Classification Search
USPC ..... 99/279, 283, 287, 295, 323, 516, 532, 99/300; 426/77, 78, 79
See application file for complete search history.

(56) References Cited

U.S. PATENT DOCUMENTS

| | | | | | |
|---|---|---|---|---|---|
| 3,083,101 | A * | 3/1963 | Noury | 99/295 |
| 3,309,980 | A * | 3/1967 | Bozek | 99/295 |
| 3,446,624 | A * | 5/1969 | Luedtke | 426/77 |
| 5,472,719 | A | 12/1995 | Favre | |
| 5,505,120 | A * | 4/1996 | Albertson | 99/286 |
| 6,869,627 | B2 * | 3/2005 | Perkovic et al. | 426/77 |
| 7,604,826 | B2 * | 10/2009 | Denisart et al. | 426/77 |
| 2002/0035928 | A1 * | 3/2002 | Kataoka | 99/279 |

(Continued)

FOREIGN PATENT DOCUMENTS

| | | | | |
|---|---|---|---|---|
| FR | WO03/059778 A2 * | 7/2003 | | B65D 81/00 |
| GB | 899055 * | 4/1960 | | A47J 31/06 |

(Continued)

*Primary Examiner* — John E Simms, Jr.
(74) *Attorney, Agent, or Firm* — K&L Gates LLP

(57) ABSTRACT

The invention relates to a capsule for delivering a drink by injecting a pressurized fluid comprising a body (2), an injection wall (3), a chamber (4) containing a bed of food substance to be extracted, means for retaining the internal pressure (5) in the said chamber. The improvement consists in the provision of an injection space (7) allowing a means of injecting fluid in the form of at least one jet of fluid to be introduced through the injection wall and in providing a means (6) for breaking the jet of fluid and distributing the distribution of fluid at a reduced speed across the surface of the bed of substance. These means may adopt various forms such as that of a rigid or flexible perforated wall, or a layer of discrete elements or a spongy layer. Such a capsule improves the flow of liquid extract through the pressure retaining means (5) and improves the extraction conditions.

23 Claims, 13 Drawing Sheets

(56) References Cited

U.S. PATENT DOCUMENTS

| | | | | |
|---|---|---|---|---|
| 2003/0005826 | A1* | 1/2003 | Sargent et al. | 99/279 |
| 2003/0172813 | A1 | 9/2003 | Schifferle | |
| 2004/0112222 | A1 | 6/2004 | Fischer | |
| 2007/0259074 | A1* | 11/2007 | Searchilli et al. | 426/78 |

FOREIGN PATENT DOCUMENTS

| | | |
|---|---|---|
| GB | 899 055 | 6/1962 |
| WO | 03/059778 | 7/2003 |
| WO | 03/082065 | 10/2003 |

* cited by examiner

CAPSULE FOR PREPARING AND DELIVERING A DRINK BY INJECTING A PRESSURIZED FLUID INTO THE CAPSULE

The invention relates to a capsule configured to prepare and deliver a drink which is extracted and/or dissolved from a food substance contained in the said capsule and by injecting the pressurized fluid into the said capsule.

Numerous examples of capsules containing a food substance intended to be extracted under the pressure of a fluid, generally water, in order to form a drink are known. An example of a capsule is described in patent EP 0512468. The capsule is designed to be inserted in an extraction machine. The closed end of the capsule comprises a tearable membrane which is opened, under the effect of the pressure of a fluid, upon contact with a membrane support equipped with reliefs in order to tear the membrane and with ducts to allow the liquid extract to pass.

Another example of a capsule is described in application WO 03/059778 A2. The capsule comprises a closed chamber containing the substance to be extracted or dissolved and also comprises means for opening the chamber. The opening of the chamber is achieved by increasing the pressure within the chamber; this pressure is increased by introducing a quantity of pressurized fluid into the chamber. When the internal pressure is sufficient, a membrane or wall tears or cuts upon contact with raised elements and the drink flows through the openings thus produced.

The capsules may alternatively be permeable enclosures containing a filter or alternatively semi-permeable enclosures comprising a filter part. There are also capsules in existence that comprise one or more restrictions forming a jet of drink and which may or may not be associated with filtering walls.

It is known practice to employ substances for mixing (soluble or dispersible) and to carry out extraction under pressure using the same machine so as to offer a greater variety of drinks. For example, one and the same machine can be used to prepare an "espresso" coffee when the capsule contains ground coffee or a hot chocolate when the substance contains a mixture of cocoa and powdered milk. However, it is found that filling a capsule with a substance of a different nature is not enough to obtain a drink of good quality in terms of aroma, taste and/or volume of froth for example.

In particular, the various injection, mixing or wetting conditions may have a considerable influence over the quality of the drink produced. Whether considering a substance to be extracted, originating from a grinding, compacted into a capsule, or considering a substance to be dissolved or dispersed in a liquid, such as a soluble coffee or a milk-based substance such as a cappuccino, hot chocolate or the like, the way in which the water circulates through the capsule has an influence over the extraction or mixing conditions and therefore on the end quality of the drink. Thus, a product such as coffee or chocolate needs preferably to dissolve or disperse quickly and fully, preferably producing some froth, whereas a soluble tea preferably needs to dissolve quickly without producing any froth. The dissolving or dispersing needs to be total, uniform, quick and without forming lumps or flocculation. In the case of products to be extracted such as ground coffee, the optimum wetting conditions are different. The product needs to be completely wetted uniformly, that is to say without creating preferred paths that the water follows through the bed of coffee.

Thus, the way of injecting the drink may vary according to the type of substance contained in the capsule. For example, co-pending European patent application No. 03019163.9 filed on 25 Aug. 2003 relates to a method for preparing a drink by injecting a liquid through a capsule which contains a substance forming a vortex effect inside the capsule using at least one jet of pressurized water located eccentrically in the capsule. Such a configuration works well with the substances that need to be dissolved. A jet of pressurized water causes turbulence which encourages the substance in the capsule to dissolve quickly and fully.

However, the injecting of pressurized water in one or several jets in order to form turbulence is not suitable for extracting a drink from a bed of substance such as ground coffee or the like. In particular, the jet of water stirs up the substance and causes the fines (or small-sized particles) to settle to the bottom of the bed. The fines therefore collect near the orifices and obstruct them and considerably reduce, if not stop, the flow of the drink.

There is therefore a need for a capsule which is able to accept the fluid from the injection means of the water jet type but without presenting the problems associated with these means; namely without generating a mixing up of the bed and, therefore, without causing the fines to settle out and therefore without obstructing the openings through which the drink is supposed to pass.

Another problem encountered in the field of capsules relates to the reproducibility of the quality of the delivered product. This quality is particularly affected when the time taken for the drink to flow varies from one capsule to another. There are various factors that may influence this flow time including, in particular, the thickness, the flatness and/or the density of the bed of substance to be extracted. The thickness, the flatness and/or the density of the bed may vary as the capsule is transported and stored. For example, when the capsule is not kept horizontal, the bed of substance has a tendency to pile up on one side, which will form regions in which the fluid passes more quickly and other regions in which the fluid passes more slowly through the substance.

It is therefore important to ensure control over the thickness, the flatness and/or the density of the bed of substance to be extracted so as to guarantee good reproducibility of the extraction conditions.

The present invention aims to provide a solution to these problems. Hence, the invention relates to a capsule for delivering a drink by injecting a pressurized fluid into the capsule comprising a hollow body and an injection wall attached to the body, a chamber containing a bed of at least one food substance to be extracted, means for retaining the internal pressure in the said chamber. According to an improvement of the invention, the capsule comprises means configured to break the jet of fluid so as to reduce the speed of the jet of fluid injected into the capsule and distribute the fluid across the bed of substance at a reduced speed.

In the context of the invention, food substance means any edible substance adapted for the preparation of a food, soup, beverage, medical, clinical and/or nutritional product.

In one embodiment of the invention, an injection space is provided, allowing an injection means in the form of at least one jet of pressurized fluid to be introduced through the injection wall. Thus, the fluid injection space is kept separate from the chamber by the means configured to break the jet and reduce the speed of the injected fluid jet and to distribute the distribution of fluid across the bed of substance.

Hence, the capsule according to the invention may accept a fluid injected by means of an injection member which, in a normal capsule, would cause the substance in the capsule to be stirred up but which, by virtue of the means of breaking the jet and for distributing the flow at a reduced speed, prevents the mixing-up from happening within the substance, and in particular, does not cause the fines to settle out.

According to one aspect of the invention, the means for breaking the jet and for reducing the speed comprise a transversal wall which is configured to separate the injection space from the chamber containing the bed of substance in such a way as, directly or indirectly, to break the jet produced by the injection means introduced into the said injection space.

According to one embodiment of the invention, the wall comprises welding edges which are welded against the internal surface of the hollow body in such a way as to position the said transversal wall inside the hollow body and back from the injection wall.

This particular embodiment combines several advantages:

- the jet-breaking means are close to the surface of the food substance, for example the bed of ground coffee, and this allows the bed of coffee to be held better in place;
- welding the edges of the means to the inside of the body makes it possible to prevent the liquid and/or solid extract from rising up along the edges of the body of the capsule, the bed of substance also remaining better compacted under the combined effect of the wall thus welded and the pressure of the fluid;
- the means are, by the same token, kept away from the injection wall, including along the edges, and this ensures injection by intrusive means which can be inserted into the capsule at any point, for example along the edges, without however damaging the wall of jet-breaking means, such as puncturing it for example,
- as a result, the injection wall can be made of a flexible and inexpensive material because it is not subjected to stretching or tearing caused by the injection means of the system.

Hence, in this embodiment of the invention, it will be preferable to use a wall formed of a deformable flexible film. Such a wall comprises welded edges which are applied to an internal portion of the hollow body near the top surface of the food substance.

The wall extends laterally in the form of welding edges bent up and welded against the internal surface of the body. The width of the welding edges is of the order of about 1 to 10 mm.

The flexible film comprises at least one welding layer made of a material compatible with being welded to the hollow body of the capsule. In a preferred example, the hollow body comprises a surface made of food grade polyolefin(s), most preferably polypropylene and the flexible film comprises a welding layer, itself made of food grade polyolefin(s), most preferably polypropylene.

The welding layer is preferably arranged on the side of the wall facing the injection wall, set back from the edges therefrom.

The wall of the means for breaking the injection jet may comprise one or more support layers for the welding layer. The support layer is not necessarily compatible with being welded to the hollow body. It may be a layer of polymer or a woven, a mat or the like, attached firmly to the welding layer. The wall may thus be a laminate such as PP/PET, PP/PE or PP/PA or alternatively, a monolayer such as PP or PE.

Surprisingly, the film may be both very fine and act as a jet breaker and splitter without rupturing. The thickness is less than 500 microns, preferably less than 200 microns, more preferably still, between 20 and 100 microns, for example 30-40 microns.

The wall is equipped with a multitude of holes distributed uniformly over the surface to allow the injection liquid to pass through the bed of substance.

The film may be applied to the body of the capsule by a continuous method after the paying out, from a roll, then the cutting of the wall and the application and welding of the edges by means of a welding die of appropriate size and shape so that it is at least partially inserted inside the body of the capsule.

Welding can be carried out using suitable technologies such as thermal welding, ultrasonic or induction welding.

In one configuration, the wall is orientated to face the said jet of fluid from the said injection means so as to break the jet directly. In one embodiment, the said wall is thus positioned substantially parallel to or concave (the bulge being directed towards the closed end or bottom of the body) the injection wall. The expression orientated "facing" with respect to the jet is to be understood as meaning that the wall is arranged in such a way that the jet is directed in such a way as to enter into a direct impact against the wall, it being possible for the jet to arrive against this wall either with a certain angle of inclination or normal to the wall.

For preference, the means for breaking the jet and distributing the distribution of fluid across the chamber comprise a multitude of openings passing through the said wall in such a way as to distribute the flow of fluid across the bed of substance.

Thus, the wall serves directly or indirectly to break the jet or jets of fluid entering the capsule bound for the chamber, more specifically in the injection region provided for that purpose. The fluid therefore loses some of its kinetic energy as it strikes the wall directly or indirectly and then the fluid thus slowed splits into a multitude of streams through a plurality of openings so that the speed of the fluid passing through the wall is itself divided in proportion to the number of openings. A fluid piston is thus created that enters the chamber through the openings over practically the entire cross section of the bed of substance, and this encourages a rise in pressure in the chamber without creating an effect of turbulence in the substance. The fluid can therefore pass through the openings in a distributed manner at low speed, without creating turbulence, without significantly lifting the bed and without stirring up the substance itself. The distribution through a multitude of openings also contributes to the wetting of the substance uniformly while at the same time avoiding encouraging the creation of preferred paths through the substance.

As a preference, the openings of the perforated wall are distributed substantially uniformly across the wall so as to distribute the stream of fluid substantially uniformly across the bed of substance. Uniformity of the distribution of the openings is to be understood to mean a distribution of the openings over the entire surface of the wall, not necessarily symmetrically, but at least without any significant variation in the spacing between two adjacent openings. However, the holes could as well be placed in a random manner or in an organized but non-uniformed manner. For instance, the density of holes could be greater at the periphery than at the center of the capsule to favour entry of a larger amount of water in the bed from the periphery of the bed of substance toward the center line of the capsule.

The number of openings must be enough to ensure good distribution of fluid across the substance. As a preference, the number of openings is greater than 10, preferably at least 20, more preferably still at least 50 or more. The shape of the openings is not critical. It may be circular, oblong, rectangular or some other shape. The size of the openings may vary. The surface area of each opening is preferably between 0.1 and 3 $mm^2$.

The wall may adopt numerous forms in order to fulfil the required functions of reducing the speed of the jet of fluid and distributing the fluid across the bed of substance. In general, the perforated wall is chosen from a plastic wall with holes, a film with holes, a grating, a layer of woven or nonwoven material, a layer made of a porous material such as a layer of sponge, cotton or gauze or a combination of these. For instance, a layer of porous material can be inserted as a loose piece in the capsule.

According to one aspect of the invention, the substance to be extracted essentially occupies the entire chamber. The perforated wall is immobilized a distance 1 mm or less away or preferably actually in contact with the surface of the bed of substance in the chamber so as to confine the substance in the chamber. Immobilizing the wall is to be understood in the sense that the wall is arranged in the capsule in such a way that it can be neither moved nor significantly damaged upon contact with the jet of fluid entering in the injection region. Thus, the wall maintains its position and its physical integrity so that it plays its part in reducing the speed and distributing the fluid across the substance throughout injection into the capsule.

Confining the substance in the chamber makes it possible to avoid the substance being significantly stirred up during extraction and, during transport and storage, makes sure that the thickness of the bed is maintained regardless of the spatial orientation of the capsule.

For preference even, the wall of the jet-breaking means is configured in the capsule to compress the bed of substance. Thus, keeping it under compression allows the bed of substance to keep its initial density substantially unchanged, in the non-hydrated state, from the time the capsule is sealed at the time of filling up to the moment when the capsule is used. The compression also prevents any mixing up of the substance and any possible movement of the smallest sized solid particles, particularly at the bottom of the bed.

In one advantageous embodiment, the means for breaking the jet of fluid and for distributing the fluid comprise a dish with a perforated wall which is inserted and immobilized in place inside the body. The dish shape presents certain advantages. The dish delimits within itself the injection region needed to accept the injection means. Thus, the depth of the dish is determined as a function of the injection means and of their arrangement within the intended injection space. The dish shape is more stable than a simple rigid sheet and is therefore better kept immobilized in the body of the capsule. The dish can thus be kept in contact with, or better still in compression against, the bed of substance by a membrane welded over the body of the capsule and which rests against the edges of the dish. The membrane can thus be punctured by the injection means so as to create one or more jets within the dish. Another advantage of the dish is its ease of insertion at the time of manufacture. Thus, the dish can simply be placed inside the capsule without fixing it. However, one disadvantage of the dish stems from the possibility of solid and/or liquid extract rising back up along the edges and out of the chamber. If the space intended for injection is soiled with, for example, coffee grounds, that leads to risks of the orifices in the wall itself becoming blocked, and therefore degradation of the distribution of the stream of water through the bed of substance and also a risk of the injection means becoming blocked. Another disadvantage stems from the industrial placement in the capsule, which requires space for several successive workstations: storage, picking, alignment and application of the dishes. The use of a dish therefore proves more expensive on an industrial scale than the use of a film, not to mention the additional cost associated with the material and manufacture of the dishes.

Other possible forms incorporating the jet-breaking means are possible without departing from the scope of the invention. These may include a simple sheet, flat, corrugated or otherwise, positioned in contact with the bed of substance and the cross section of which substantially corresponds to the cross section of the top surface of the bed of substance. The edges of the sheet are thus held in place by fixing means or simply butt against the internal walls of the body of the capsule. In this case, the wall is perhaps rigid so as to avoid any unwanted movement within the capsule, particularly any inclination due to transport or due to the force of the jet. One disadvantage is, however, the possibility of the extract rising back up along the edges because of a lack of sealing.

In another possible form, the means for breaking the jet and distributing the fluid across the bed of substance comprises a flexible film equipped with orifices and welded against the edges of the body, which film has the ability to distend under the thrust of the injection fluid and press against the surface of the bed of substance.

In another possible form, the distributing and jet-breaking means comprise a layer or a mass of discrete elements or at least one layer of spongy material which separates the fluid jet inlet from the surface of the bed of the substance. The layer or mass of discrete elements or spongy material then replaces or supplements the perforated wall and occupies substantially all or some of the "dead" volume of the chamber and/or of the injection space. The discrete elements may be in the form of beads, granules, sticks or the like. They are preferably made of expanded plastic. The plastic may be polystyrene, polypropylene or other appropriate materials. The density of the material used to form the discrete elements is preferably chosen to be lower than the density of the substance so as to prevent the elements, for example the beads, from settling down to the bottom of the capsule. The elements prevent the jet from striking the surface of the bed of substance directly and thus create a multitude of small empty spaces able to produce a flow network for the fluid entering the bed of substance. A spongy material can be a synthetic or natural sponge or textile such as gauze or cotton.

As mentioned previously, the wall for breaking the jet may also be a simple flexible membrane but, in this case, it is preferable to anticipate immobilizing it in the capsule with respect to the bed of substance so as to prevent it from moving or curling up on itself, as this would render it ineffective. Immobilization may be achieved by various means such as by means of attachment to the body of the capsule or to the bed of substance itself. In one possible embodiment, the wall forms a perforated package which holds the bed of substance in one block. The packaging may be made of a film material heat-shrunk around the bed, so as to keep the bed at the desired density. In a preferred embodiment, the wall is welded or bonded to the internal faces of the body.

According to one aspect of the invention, the capsule comprises pressure restraining means which allow the fluid inside the chamber to increase in pressure sufficiently to improve the extraction of the substance. These retaining means also filter the drink through at least one orifice obtained as a result of the rise in pressure in the capsule or through the construction in the capsule. The pressure retaining means therefore comprise at least one wall comprising at least one flow orifice or able to produce at least one flow orifice as a result of the pressure in the capsule such as by tearing, piercing, cutting of a wall for retaining the fluid in the chamber against appropriate raised means.

Thus, according to one possible embodiment, the means for retaining the pressure in the capsule comprise:

a puncturable membrane, raised elements which open the said membrane in order to create punctures and allow the liquid extract to pass through the said punctures; the punctures in the membrane being obtained under the effect of the rise in pressure of the fluid that is introduced into the chamber of the capsule.

One of the advantages of this configuration is that the capsule carries its own opening means, which therefore allows the opening characteristics to be tailored to suit the types of substance contained in the capsule and/or the types of drink to be produced. Another advantage is that it reduces the risk of cross-contamination when drinks of various kinds are prepared one after another.

In an advantageous embodiment, the raised elements are positioned on the outside of the chamber. The membrane then presses against the raised elements placed on the outside of the chamber. Such a construction has the advantage of better controlling, in particular, the opening time, the size of the punctures and the flow of the drink extract. In another embodiment, the raised elements are in the chamber itself. The raised elements are pressurized by the fluid entering the chamber itself and the elements press against the puncturable membrane to create punctures and allow the drink extract to flow freely.

The raised elements may be of different shapes, sizes and in different numbers according to the need. The shape, size and number of the raised elements determine the extraction characteristics, amongst other things, the rise in pressure inside the capsule, the delay to opening, the flow rate and flow time for the drink. The raised elements may comprise pyramids, domes, cone frustums, elongate ribs, spikes or blades. For a more delayed opening which promotes extraction of certain aromatic components or molecules from the coffee, for example, the raised elements are rather of non-salient shape; pyramids, cone frustums, ribs or domes will be chosen. To accelerate the creation of the punctures, and therefore generate opening and flow, salient elements such as spikes or blades are recommended. The number of raised elements is also dependent on the characteristics and nature of the desired drink. A higher number of raised elements has a tendency to delay the time before opening and the flow of the liquid extract. Their number may therefore vary between 1 and 200 elements.

According to another possible embodiment of the invention, the pressure retaining means comprise a filter wall comprising pre-formed openings or lines or points of weakness. Thus, instead of anticipating opening in order to allow the drink to flow, by puncturing a membrane in contact with raised elements, the pressure is restrained by a wall which by itself creates enough of a pressure drop to encourage a rise in pressure in the capsule and delay the flow of the drink. The pre-formed openings may be simple holes, pores, tortuous ducts or the like. The lines or points of weakness are intended to create openings once a determined pressure threshold has been exceeded, in order to allow the drink through. These may be points or lines of reduced thickness produced in the filter wall or precuts which open up and/or widen under the pressure of a fluid. Likewise, the invention aims to avoid any significant stirring-up of the substance which could cause the fines to settle out and block these openings and impede the passage of the drink.

In an advantageous embodiment, the body comprises a collector for the drink and at least one pipe or passage for dispensing the drink. Likewise, the collector comprises drink overflow means collaborating with the pipe so as to slow the stream of drink leaving the capsule.

The invention also relates to a system for producing and delivering a plurality of drinks by injecting a pressurized fluid into capsules comprising:

an injection device configured to produce at least one pressurized fluid jet in the capsules;

and at least one capsule as previously described.

According to a preferred embodiment, the injection device is configured to pierce the injection wall and introduce at least one injection nozzle configured to send at least one pressurized fluid jet in a direction of preference. Such a direction is preferably towards the bed of substance. In such a case, the device is configured in such a way as to produce, in capsules without the said means for breaking this jet of fluid, turbulence in the substance which encourages rapid dissolving and/or the production of froth. The injection device introduces the injection nozzle eccentrically into the capsule so that it is closer to the edges of the capsule than it is to the middle of the capsule. Such a direction of injection further encourages the creation of swirling movements in capsules that do not have the said jet-breaking means, and this improves the dissolving of the substance and reduces the time taken to achieve this. The jet speed must be high enough to produce turbulence in the product inside the capsule in the absence of the jet-breaking means. To do that, the injection means produce at least one jet, the initial linear speed of which is at least 5 m/s, preferably at least 7 m/s.

The invention also relates to a system for producing and delivering a plurality of drinks by injecting a pressurized fluid into capsules comprising:

an injection device producing at least one pressurized fluid jet in the capsules;

and an assortment of at least first and second capsules;

each capsule in the assortment comprising:

a body and an injection wall, a chamber containing at least one food substance, means for retaining the internal pressure in the said chamber, characterized in that the first capsules comprise means configured to break the jet and distribute the flow of fluid across the substance in such a way as to reduce or eliminate the mixing of the substance in the chamber by comparison with the said second capsules which are themselves configured without these means so as to encourage, unlike the said first capsules, a certain mixing of the substance in the chamber of the second capsules.

The system according to the invention therefore provides a solution in which the capsules can be tailored to a common injection device while at the same time, depending on the type of capsule, stirring up or, on the other hand, not stirring up, or at the very least significantly reducing the amount of stirring-up.

According to a preferred embodiment of the system, the first capsules comprise a chamber in which the substance is confined without a head space;

the second capsules comprise a chamber in which the substance occupies between 1 and 100% of the chamber. Thus, in the first capsules, the possibility of movement of particles of substance in the capsule are eliminated, whereas the second capsules have no particular constraint on the filling of their chamber, the fill rate then being dependent on factors such as the nature of the substance, the volume of drink to be produced, etc.

According to another feature, the first capsules comprise a substance to be extracted, such as ground coffee or non-soluble tea; and the second capsules comprise a substance to be dissolved or dispersed in a liquid.

Thus, in the first capsules, the substance is wetted by the fluid at the time of extraction but the substance is kept confined in the chamber so that no significant stirring-up occurs.

By contrast, in the second capsules, the volume of gas available may be great or small to start with (close to zero per cent) but, because of the complete dissolving of the substance combined with the flowing of the drink, a sufficient gas volume is always produced, making it possible to deliver frothy drinks. The jet of pressurized fluid encourages mixing in these second capsules so as to produce a great amount of stirring-up and therefore froth.

The second capsules preferably contain soluble food gel, liquid or powder, which are substances for which good and quick dissolving or dispersing in a liquid, in order to deliver the drink in a few seconds, entails maintaining a sufficient level of turbulence in the capsule. The substances in the second capsules may comprise, for example, a soluble coffee concentrate, soluble tea concentrate, milk concentrate, soup or alternatively fruit juice, or a combination of these substances.

The invention also relates to method for manufacturing a capsule for delivering a drink by injecting pressurized fluid into the capsule, the cartridge comprising a hollow body and an injection wall attached to the body, a chamber containing a bed of at least one food substance to be extracted, means for restraining the internal pressure in said chamber characterized in that a punctured element forming a jet-breaking and water distribution wall is placed transversal to the hollow body and welded to the internal side of the hollow body and at a distance from the injection wall.

In a mode of the invention, the welding operation of the punctured element is carried out after the hollow body has been filled with the food substance and before the injection wall is attached to the hollow body.

The punctured element can be welded to the hollow body by effect of heat or ultrasound.

The punctured element can be a membrane comprising a weldable side of lower welding initiation point or melting point than the opposite side.

In one mode, welding of the punctured element is carried out by holding the hollow body on a support die and engaging a welding die in the hollow body to position the punctured element and weld it to the internal side of the hollow body.

The method may further comprises:

- inserting the opening means in the hollow body then welding a first membrane to form a bottom of the chamber and separate the opening means from said chamber,
- metering out the food substance into the capsule up to a certain height in the capsule that is set back from the edge of the body,
- welding the punctured element in contact with the surface or flush with the surface of the food substance,
- attaching the injection wall to the hollow body.

Possible embodiments of the invention will now be described in conjunction with the following figures.

Figure 1:
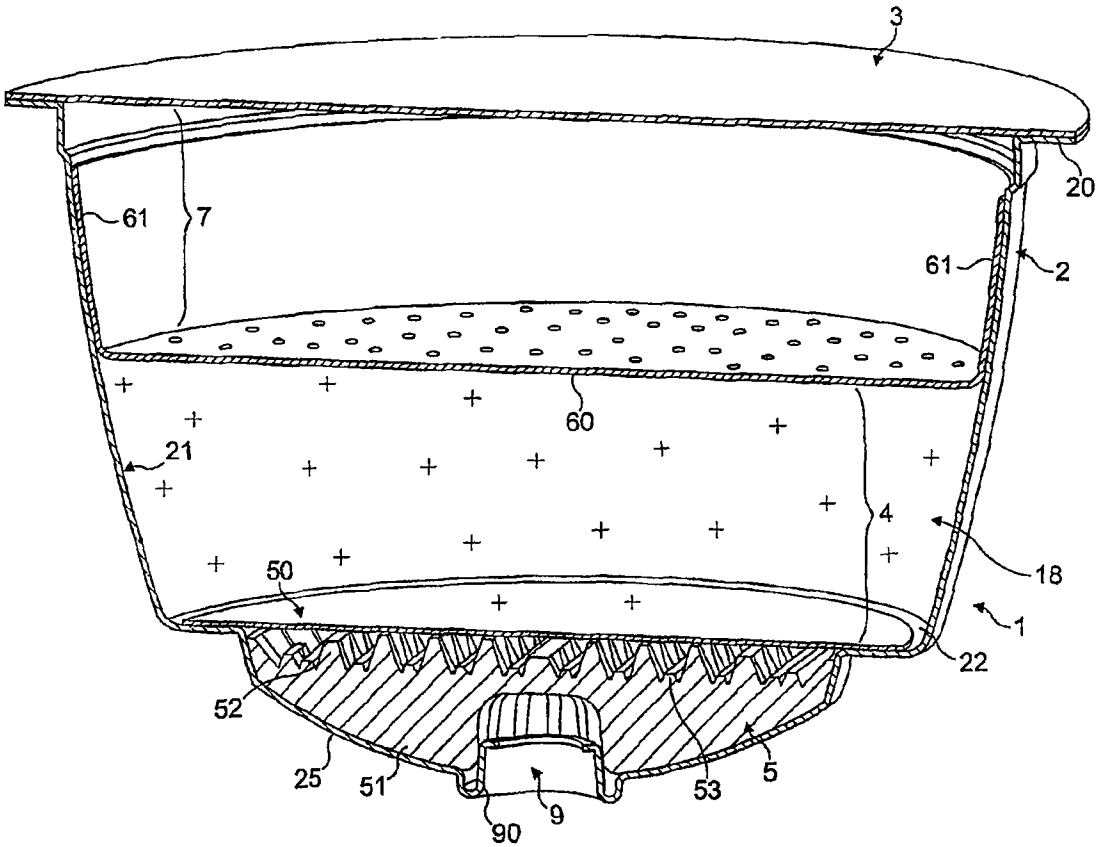
FIG. 1 depicts a view in cross section on a vertical mid-plane of a first embodiment of a capsule according to the invention.

FIGS. 1 to 4 illustrate a first example of a capsule according to the principle of the invention. The capsule 1 comprises a body 2 in the form of a cup and an injection wall 3 which closes the open part of the cup. The body may be made of thermoformed plastic, for example. It comprises upper edges 20 against which the injection wall 3 rests and is welded and/or bonded. The injection wall 3 may advantageously be a plastic or aluminium membrane or a composite multilayer that can be punctured and is impermeable to liquids and to air.

The body 2 comprises a chamber 4 in which the food substance to be extracted is housed. The food substance adopts a position in this chamber in the form of a bed of substance, of which the surfaces transverse to the passage of the fluid through the bed are delimited, on the one hand, by opening means 5 and, on the other hand, by a means 6 of breaking the injection fluid and of distributing this fluid across the chamber 4. The chamber is also delimited by the sides 21 of the body. The food substance generally contains a product to be extracted, such as ground coffee or tea. Coffee produces a fairly high percentage of fines, of the order of 5 to 30%, during the grinding process. The fines are particles of coffee the size of which is below the norm, generally below 90 microns.

The means 6 of breaking the jet of injection fluid and of distributing this fluid in the chamber generally comprises a wall 60 able to break the jet or jets of fluid entering the capsule before the fluid reaches the substance to be extracted so as to avoid stirring this substance up. In the preferred, although non limiting, example illustrated, the means 6 for breaking the jet of injection fluid and for distributing this fluid is a perforated flexible membrane 60 comprising turned-up edges 61 welded against the internal face of the sides 21 of the body. The membrane thus forms a dish thus delimiting an injection space 7 allowing an injection device foreign to the capsule to be introduced. The membrane comprises a multitude of punctures or holes allowing the fluid to flow in a manner that is distributed across the bed of the substance 18 in the capsule.

Figure 2:
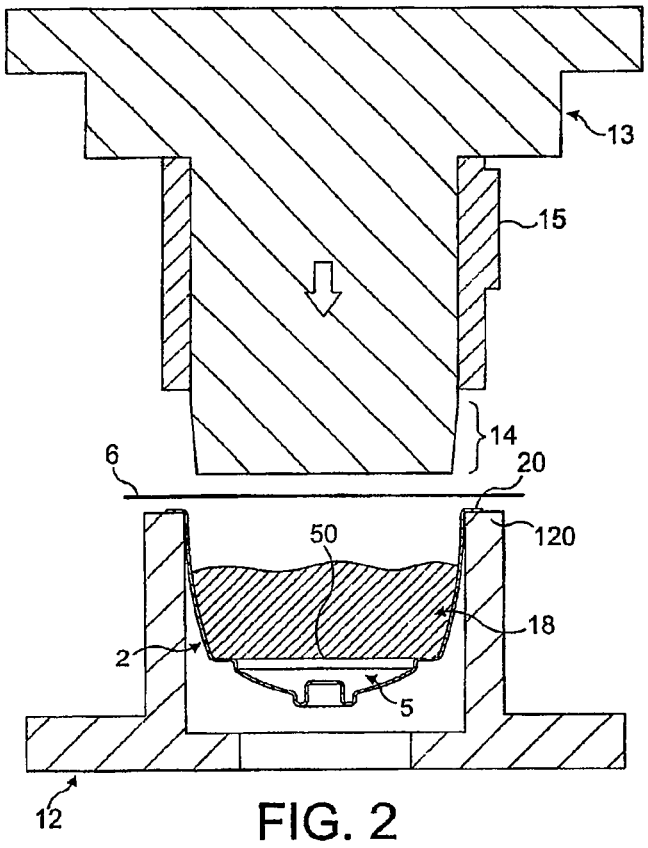
FIG. 2 depicts a step of welding the flexible means for breaking the fluid jet in the capsule.
Figure 3:
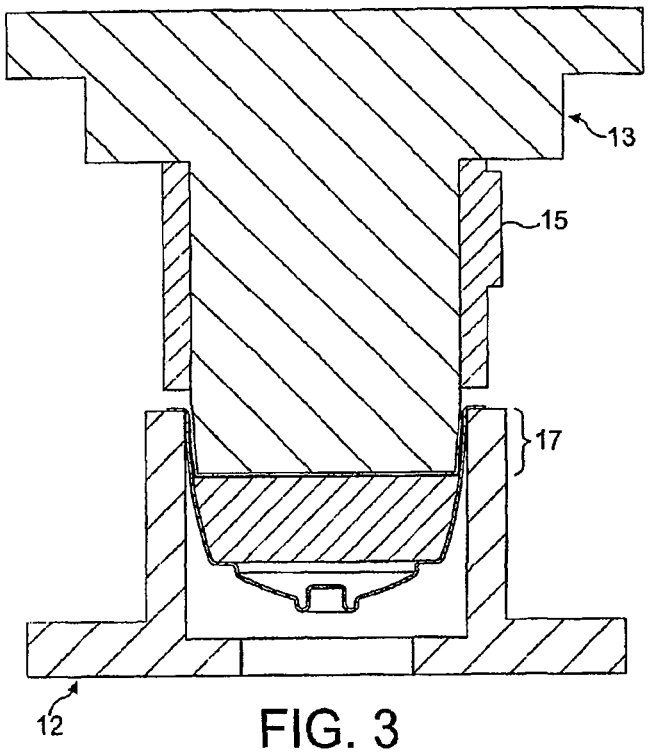
FIG. 3 depicts a second step of the welding operation.
Figure 4:
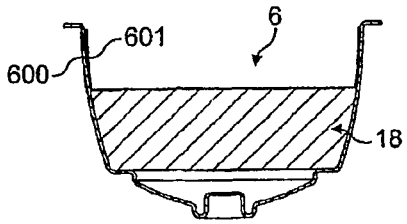
FIG. 4 shows the body of the capsule after the said means has been welded.

As FIGS. 2 to 4 show, the element 6 for breaking the jet is an element in the form of a fine membrane welded against the internal wall of the body of the capsule after the said capsule has been filled with the food substance such as a dose of ground coffee, for example. The general steps in the method of manufacturing the capsule thus comprise:

a—inserting opening means 5 in the body 2 then welding a first membrane 50 to isolate the opening means from the bottom of the chamber of the capsule;

b—metering out the food substance 18 into the capsule up to a certain height in the capsule that is set back from the edges of the body;

c—welding the punctured element 6 that serves to break the jet in the capsule in contact with the surface or flush with this surface of the food substance;

d—finally, welding the injection wall 3 against the edges 20 of the capsule.

FIGS. 2 to 4 more specifically illustrate step "b" of welding the element 6 in the capsule.

To do that, the capsule, having been filled with food substance (step a) is placed in a support die 12, the edges 20 of the body resting against bearing edges 120 of the support die. The element 6 is then interposed between the said support die and a welding die 13 comprising a welding die portion. The element 6 may thus be precut to the desired dimensions and held against the welding die by suction of air or a sucker effect or may simply be placed against the edges 20 of the body of the capsule or alternatively be held by being trapped slightly between the two die parts 12, 13.

The welding die has a narrowed, for example trunco-conical, welding portion 14 which fits against the shape of the wall of the body. A heating element 15 surrounds the die to supply the heat needed to the welding portion by conduction effect. The heating element may have passing through it or be connected to heating resistive elements (not depicted).

FIG. 3 shows the lowering of the welding die 13 into the body of the capsule in order to drive the membrane 6 back into a welding position and the actual welding of this membrane against the inside of the body. Welding takes place over a sufficient edge area 17 that it affords the element sufficient resistance to the fluid pressure. The welding is obtained by heating this edge portion until the surface of the film in contact with the internal surface of the body melts. The opposite surface of the film, that is to say the surface in contact with the welding die, is not brought up to its melting or welding initiation point, so as to prevent the film from sticking to the die as the die is withdrawn, as this would have the effect of pulling the film off or tearing it. The welding initiation point refers here to the welding temperature of the material forming the sealant at which a minimum seal strength is obtained. Seal strength is the strength of the bond at a given welding temperature. The sealing is the ability of surfaces of films to form a bond or seal that is resistant to pulling apart, peeling, delaminating or otherwise failing under the effect of pressure and heat over a period of time. As a preference, the film is therefore a laminate formed of several layers of polymers including a welding layer 600 (on the body internal wall side) made of a material with a lower melting point or welding initiation point than the external layer 601 of the film (FIG. 4). The inner welding layer is, for example, made of polypropylene when the body of the capsule is made of polypropylene; the outer layer then being made of a material such as a polyamide. If necessary, the central part of the die is cooled to prevent the film from sticking to the die, particularly as a result of melting of the layer 600, as this could then block the punctures and cause the film to stick to the die.

It may be noted that the hot-welding means may be replaced by ultrasonic welding means or other appropriate means. In one possible variant, the film forming the element 6 is brought in the form of a continuous sheet paid out by a roll or a plate and interposed between the jaw 12 and the die 13, then welded and cut. The welding may be done sequentially or simultaneously.

FIGS. 5 to 9 illustrate a second example of a capsule according to the principle of the invention. The capsule 1 comprises a body 2 in the form of a cup and an injection wall 3 which closes the open part of the cup. In this case, the means 6 for breaking the jet of injection fluid and distributing this fluid is a self-supporting plastic such as a rigid or semi-rigid plastic. The means 6 is a simple dish placed inside the body without welding.

Figure 5:
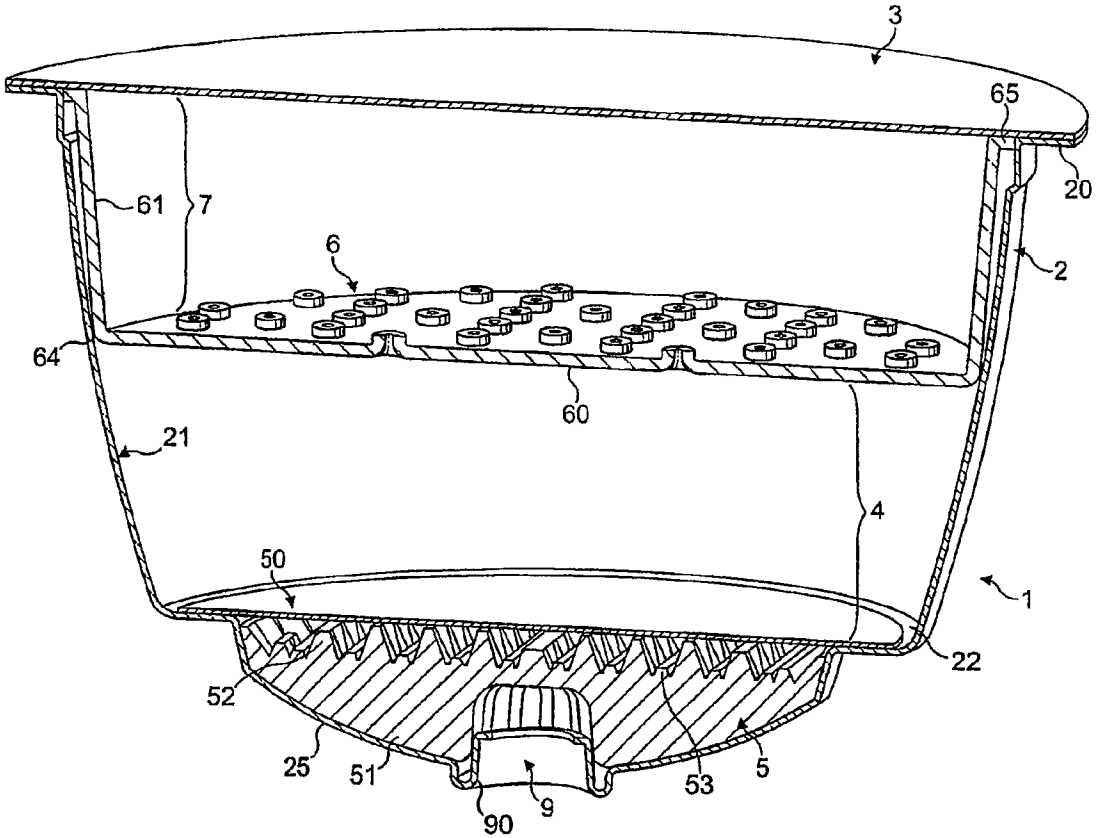
FIG. 5 depicts a view in cross section on a vertical mid-plane of a second embodiment of a capsule according to the invention.
Figure 6:
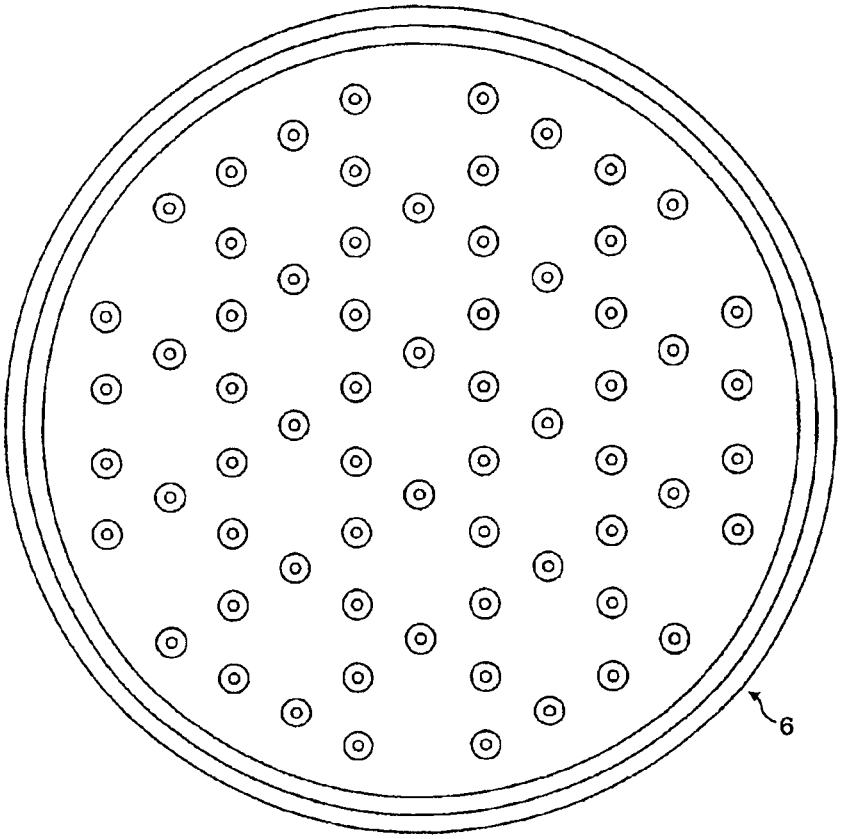
FIG. 6 depicts a view from above of one example of a means of reducing the speed of and distributing the injection fluid.
Figure 7:
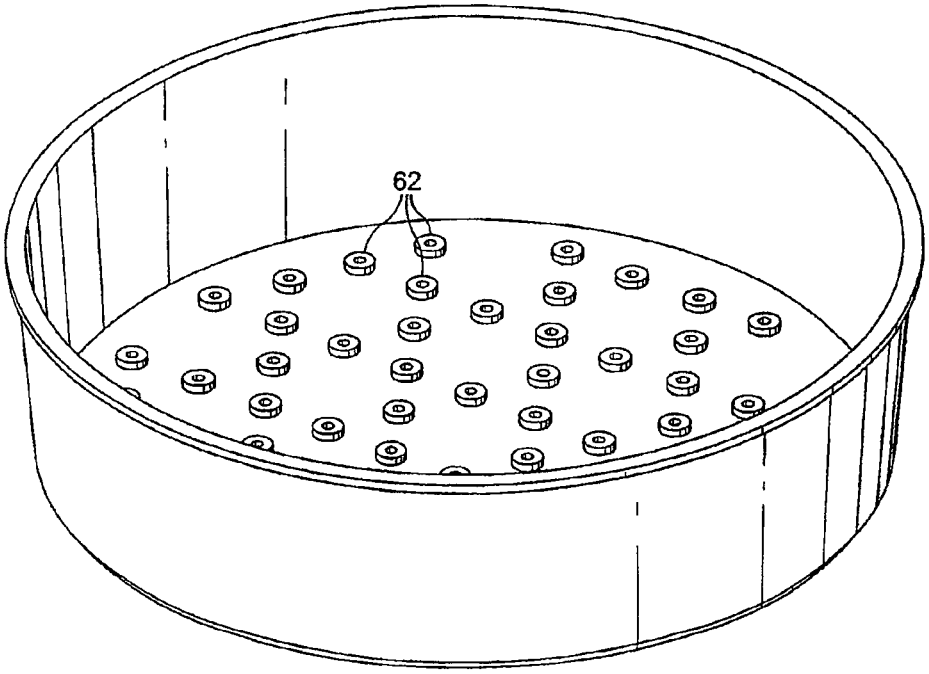
FIG. 7 depicts a perspective view from above of the means of FIG. 6.
Figure 8:
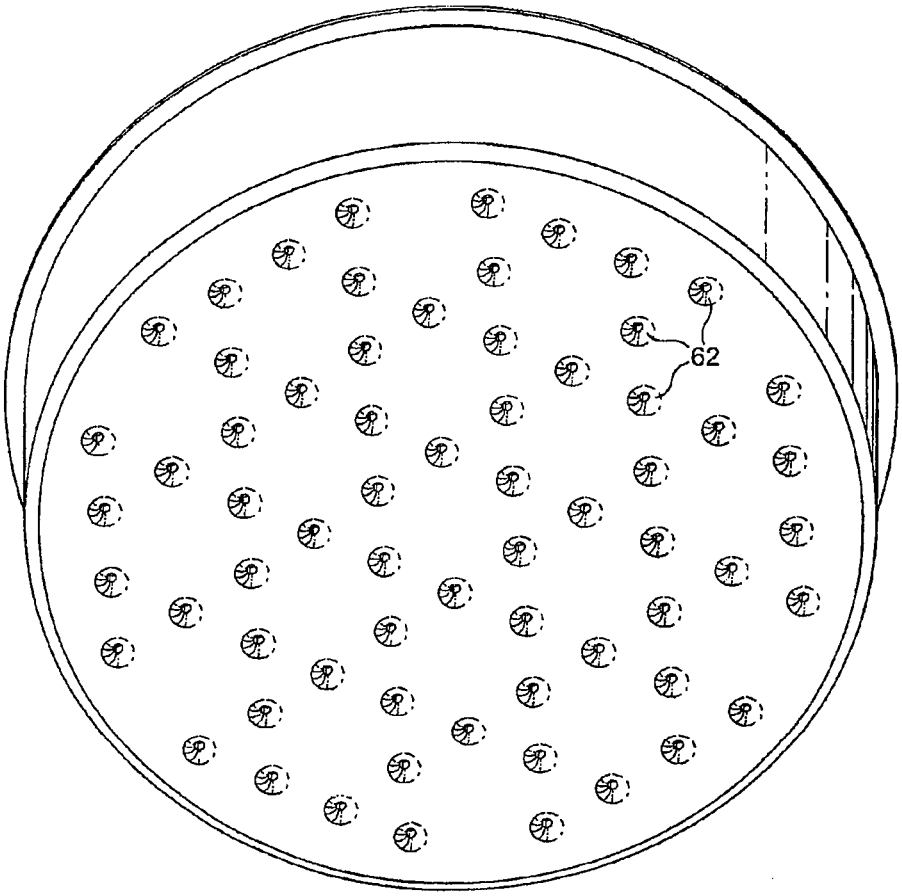
FIG. 8 depicts a perspective view from below of the means of FIGS. 6 and 7.
Figure 9:
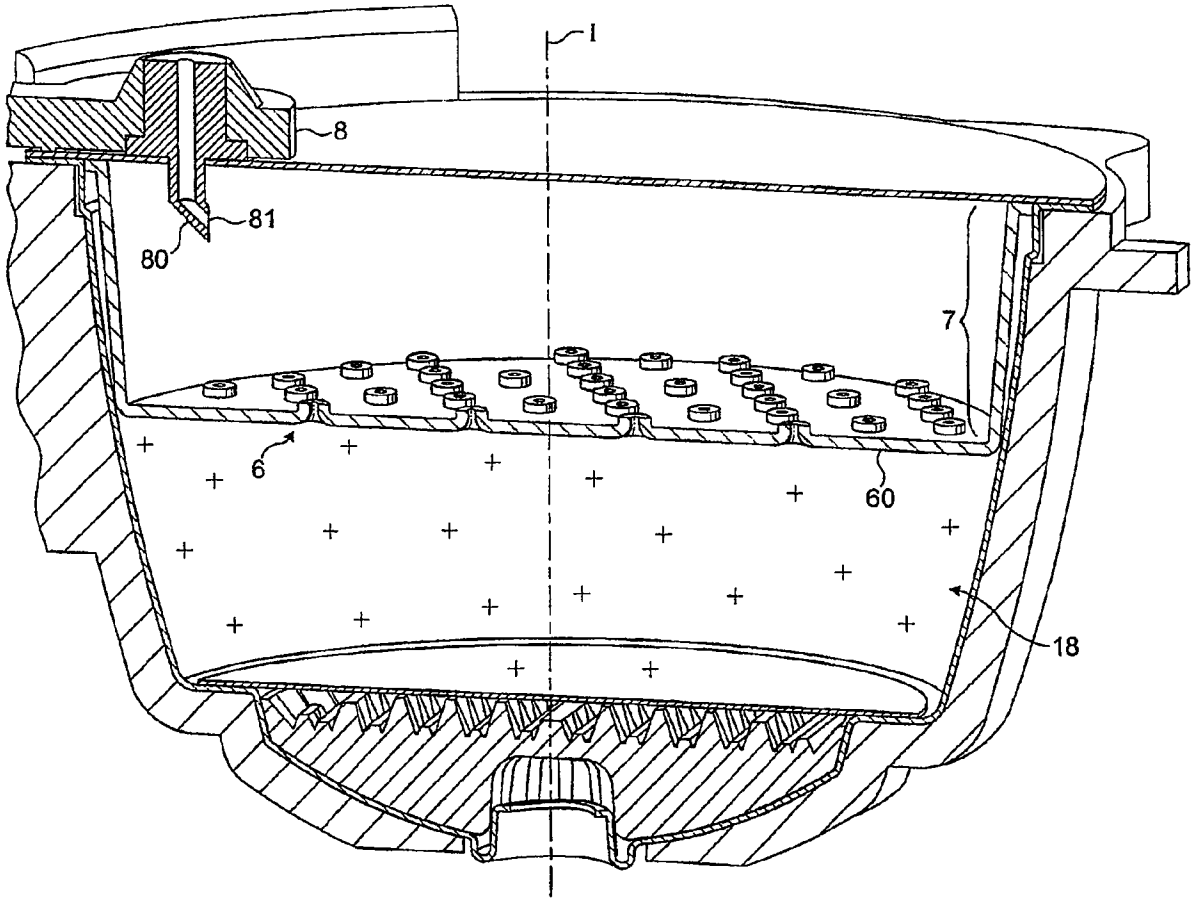
FIG. 9 depicts a view in section showing the injection of a fluid into the capsule using an injection needle passing through the injection wall of the capsule.

As shown by FIG. 9, the injection device may be a puncturing nozzle 8 equipped with a spike 80 and with one or several orifices 81 as shown by FIG. 5. The injection device is thus configured to orientate one or more jets of pressurized fluid towards the inside of the space 7. The jet of pressurized fluid is preferably aimed towards the substance contained in the capsule, either downwards or at a certain angle of inclination (as illustrated). The jet is relatively powerful with a linear speed of at least 5 m/s, preferably at least 7 m/s. This device is configured to create turbulence, or swirling movement of fluid about the central axis of the capsule, I, or alternatively a movement directed towards this axis I. Such a device is particularly effective at dissolving powders or other soluble materials while generating a stirring-up of the substance within the capsule. The capsule according to the invention does, however, possess means for breaking this jet of fluid and therefore avoids the stirring-up of the substance in the chamber and thus allows the capsule also to be rendered suitable for receiving this type of injection means. It will therefore be understood that the capsule according to the invention suits injection means which, in principle, are designed, in the absence of the means 6 for reducing the speed of the jet and for distributing, to produce a stirring-up of the substance in the capsule as in the case of powdered coffee, cocoa and/or milk. However, the modification made to the present capsule allows these injection means to be used without the problems associated with the stirring-up of the substance because the stirring-up is eliminated by the means 6 which break the jet and by the passing of the fluid through the numerous openings provided. Hence, other substances such as ground roasted coffee can be extracted without the need to change the injection means.

Thus, the dish 6 comprises a transverse or end wall 60 equipped with a multitude of holes 62 distributed across the said wall, preferably in such a way as uniformly to cover the entire surface of the said wall. Such a configuration is aimed at distributing the streams of fluid entering the chamber and passing through the substance, thereby dividing the speed at which the fluid passes through the substance and avoiding the formation of preferred fluid circulation paths.

As illustrated in FIG. 5, the dish is inserted in the body simply by placement. The injection wall 3, preferably a membrane welded to the edges 20, serves to keep the dish 60 bearing either against the sides of the body along a line of bearing 64 of the dish when the body has a narrowed shape and/or the rims 65, or alternatively bearing directly against the substance, or alternatively preferably bearing both against the body and against the substance. The dish is thus immobilized by the resting or restings between the wall 3 and the body 2 and/or the top surface of the bed of substance (not depicted). The wall 60 of the dish can thus keep the substance confined and in compression in the chamber, which guarantees reproducible flow characteristics.

The dish may advantageously be manufactured from a single piece of thermoformed or injection moulded plastic, or alternatively may be manufactured from a single piece of pressed or injected metal.

The capsules in FIGS. 1 to 9 comprise pressure retaining means 5 which allow the liquid extract or drink to be released through a passage or pipe 9 when a certain pressure has been reached in the chamber. To do that, the opening means comprise a puncturable membrane 50 connected to internal rims 22 of the body which are situated at the lower limit of the chamber. The membrane may be connected by any appropriate means of sealed connection such as by welding, bonding or other equivalent means. The membrane collaborates for opening with a disc-shaped part 51 comprising raised elements 52 delimiting a series of ducts or spaces 53.

Figure 10:
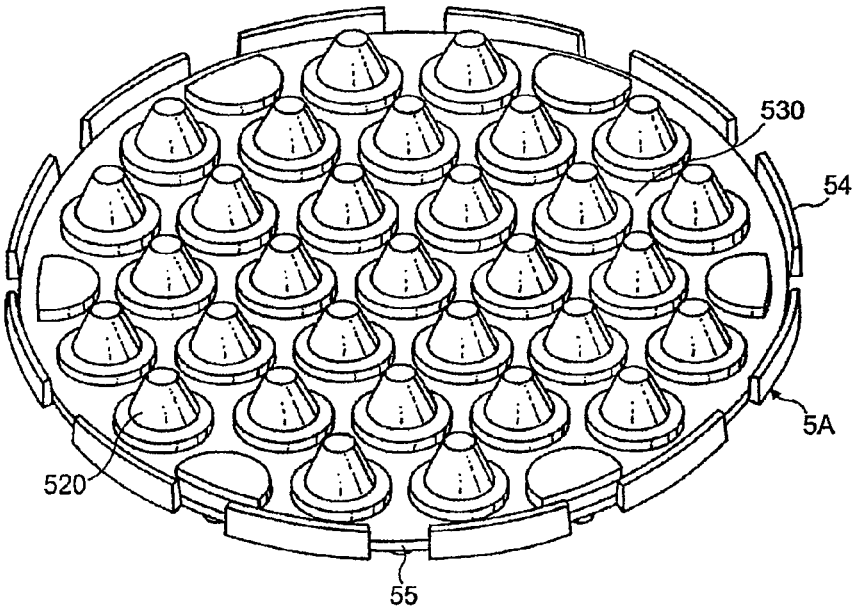
FIG. 10 shows an example of a component comprising an arrangement of raised elements for opening the capsule configured to collaborate in opening with a membrane of the capsule.

FIG. 10 shows an example of an opening piece comprising these raised elements. This piece 5A is an injection-moulded disc comprising raised elements of frustoconical shape 520 and spaces 530 for collecting the liquid extract crossing the membrane. On the sides of the piece there are rims 54 delimiting openings, passages or slots 55 to drain the drink between a collector 25 of the body and the opening piece 5A. Ribs may be provided under the piece to enhance the pressure withstand of the piece and make it easier to evacuate the drink towards the delivery pipe 9. The pipe 9 preferably comprises an overflow means in the form of an S-shaped rim, for example, which forces the stream of liquid to recentre itself, preserving the quality of the froth and thus limiting splashes.

Figure 11:
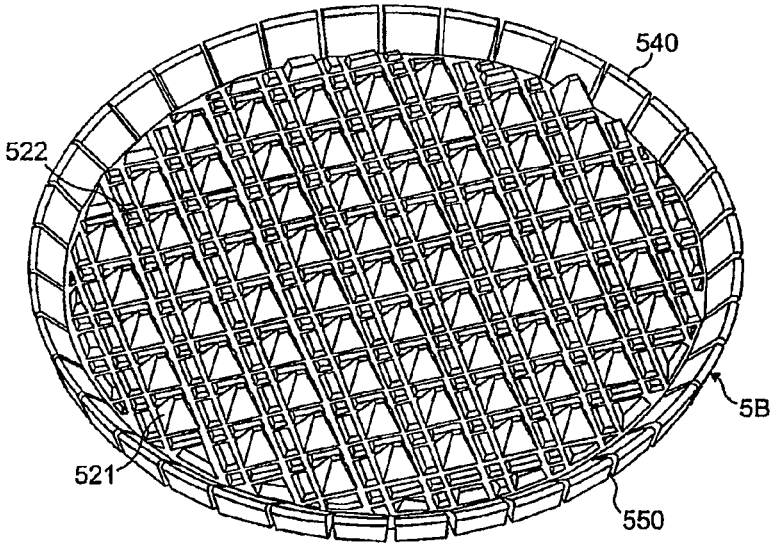
FIG. 11 shows a second example of a component comprising an arrangement of raised elements for opening the capsule.

FIG. 11 shows another example of a piece 5B used to open the membrane in which the raised elements 521 are pyramid shaped and separate ducts 522 forming a flow network over the surface of the piece. The rims 540 of the piece demarcate slots 550 for the passage of the drink.

The capsule is opened in order to release the liquid extract when the pressure exerted on the membrane 50 is such that the membrane punctures at the sites of the raised elements, therefore creating a multitude of orifices in the membrane. The fluid can flow between the surface of the raised elements and the edges of the orifices of the membrane with a filter effect so that all the solid particles remain trapped within the chamber. The extract may therefore flow between the spaces 530 or ducts 522 then through the slots 55, 550, along the edges of the collector and/or of grooves (not depicted) situated under the piece as far as the pipe 9. In the absence of the jet-breaking means, for example of the punctured wall of the dish, some of the orifices soon become blocked and the drink no longer flows or at least no longer flows at a sufficient flow rate. Given the absence of stirring-up in the substance because of the presence of the means for reducing the speed of the jet 6, the fines do not have a tendency to settle out around the approaches or against these orifices or reliefs and the drink can therefore flow normally.

Figure 12:
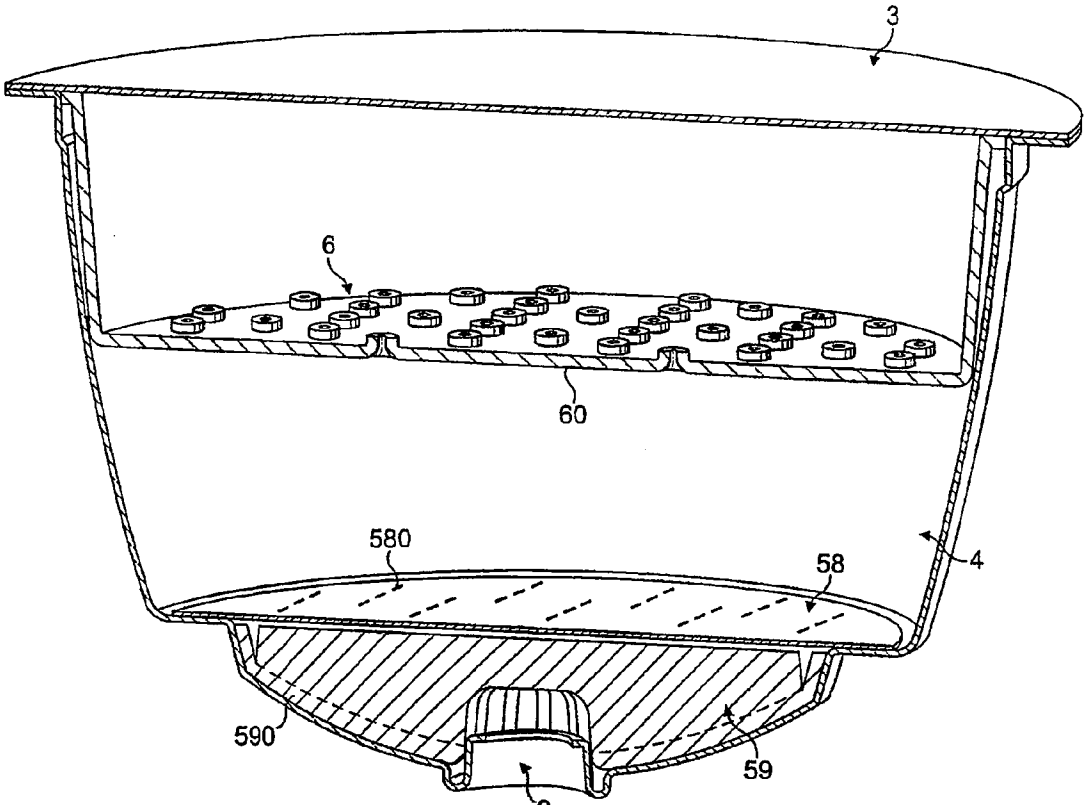
FIG. 12 depicts another embodiment of a capsule according to the invention, in which the opening means comprise a filter wall equipped with lines of weakness.

FIG. 12 shows another embodiment of the capsule according to the invention in which the difference compared with the previous embodiments stems from the retaining means 5 which have a filter wall 58 equipped with points or lines of weakness 580. In the absence of pressurized fluid, the wall 58 with the injection wall 3 forms a closed enclosure. When the fluid builds up in the chamber, the pressure increases to reach an opening pressure threshold which forces openings to form through the points or lines 580 and allows the drink extract to pass through. A support element 59, such as one comprising non-puncturing ribs, may be arranged in order to prevent the wall 58 from collapsing as a result of the pressure exerted in the chamber. The liquid can therefore flow through grooves or ducts 590 present in and/or under these support elements 59 and be discharged through the drink delivery pipe 9.

Figure 13:
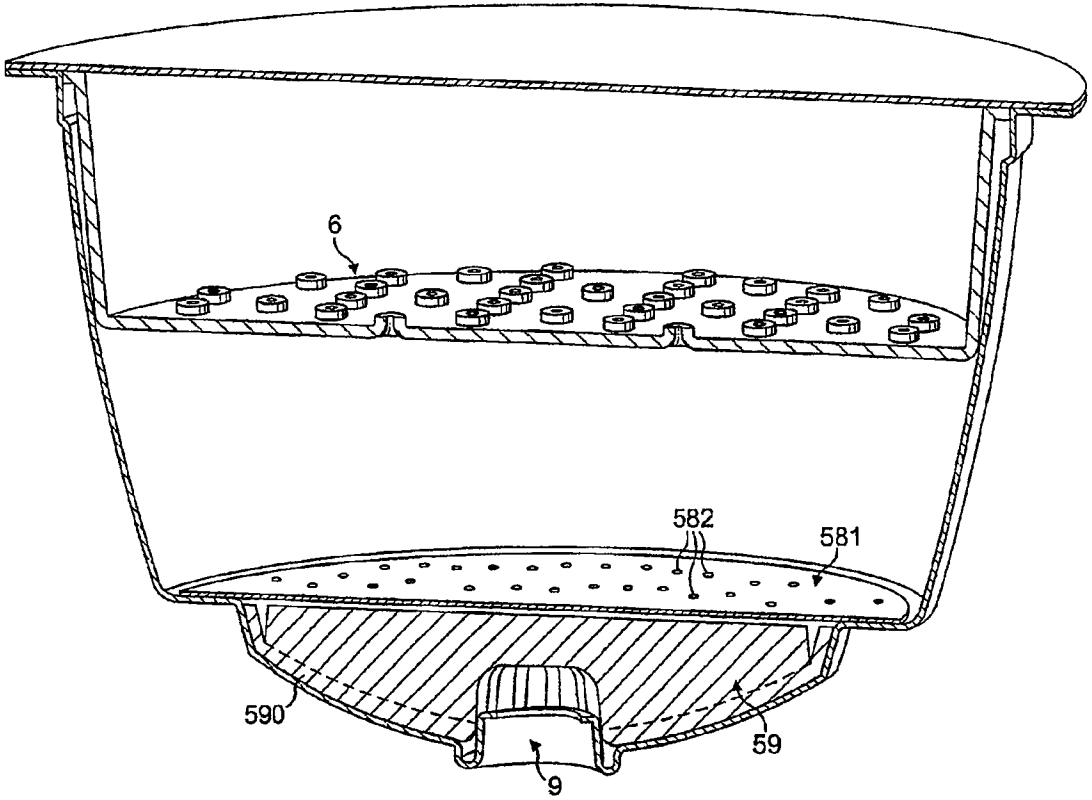
FIG. 13 depicts another embodiment of a capsule according to the invention, in which the opening means comprise a filter wall with pre-formed holes for the passage of the liquid extract.

FIG. 13 shows another embodiment of a capsule in which the wall 581 of the pressure retaining means of the chamber 4 has pre-formed openings 582 configured to allow the fluid to pass above a certain pressure in the chamber. In this case, the wall is already open and creates a pressure drop that has to be overcome so that the fluid can be collected through the pipe 9. One disadvantage of such a capsule is that it requires overwrapping or at least a pealable seal that hermetically closes the pipe 9 so as to preserve the freshness of the substance it contains.

Other possible embodiments of the pressure retaining means are conceivable without departing from the general scope of the invention.

Figure 14:
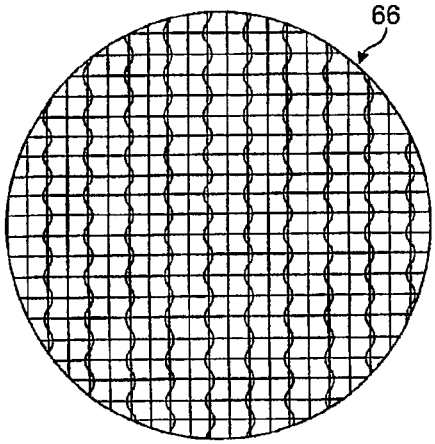
FIG. 14 shows another example of a means for reducing the speed of the jet and for distributing for the capsule of the invention.

FIG. 14 shows an example in which the means for reducing the speed of the jet and for distributing the flow of the fluid consists of an element 66 comprising at least a layer of a woven or nonwoven material. Such a layer may be a woven, a mat, made of plastic, cellulose, cotton or some other material. The element may comprise other layers or webs providing the means with rigidity such as filaments, strips or metal and/or plastic ribs, layers of porous material or the like. The element 66 may have a disc shape as illustrated in FIG. 10 or a dish shape as illustrated previously. The element 66 may alternatively be in the form of a disc which is placed in a support basket made of metal or plastic filaments the height of which defines the injection space 7.

In another embodiment (not depicted), the wall of the means for breaking the jet comprises a flexible film, equipped with a multitude of orifices, secured to the body 2 and/or to the injection wall 3 and configured to distend under the effect of the injection of the fluid between its surface and the injection wall and spread the fluid out through its orifices. The film may advantageously be retained by its edges between in the weld line of the edge 20 of the body of the capsule and of the injection wall 3. The film may be a fine film (for example 100 to 600 microns thick) made of polypropylene or elastomer, for example, equipped with multiple orifices (for example between 30 and 100). When the injection nozzle is introduced through the wall 3, it pushes the film back towards the inside without puncturing it. The water then introduced between the wall 3 and the film allows the film to distend and therefore press against the surface of the bed of substance. The film can deform elastically from a smaller initial size and/or deploy if a film of a larger initial size is provided. The film therefore stabilizes the bed of substance and prevents a turbulence/stirring-up regime from becoming established within the chamber. The water flows uniformly through the orifices of the film and through the surface of the substance.

Figure 15:
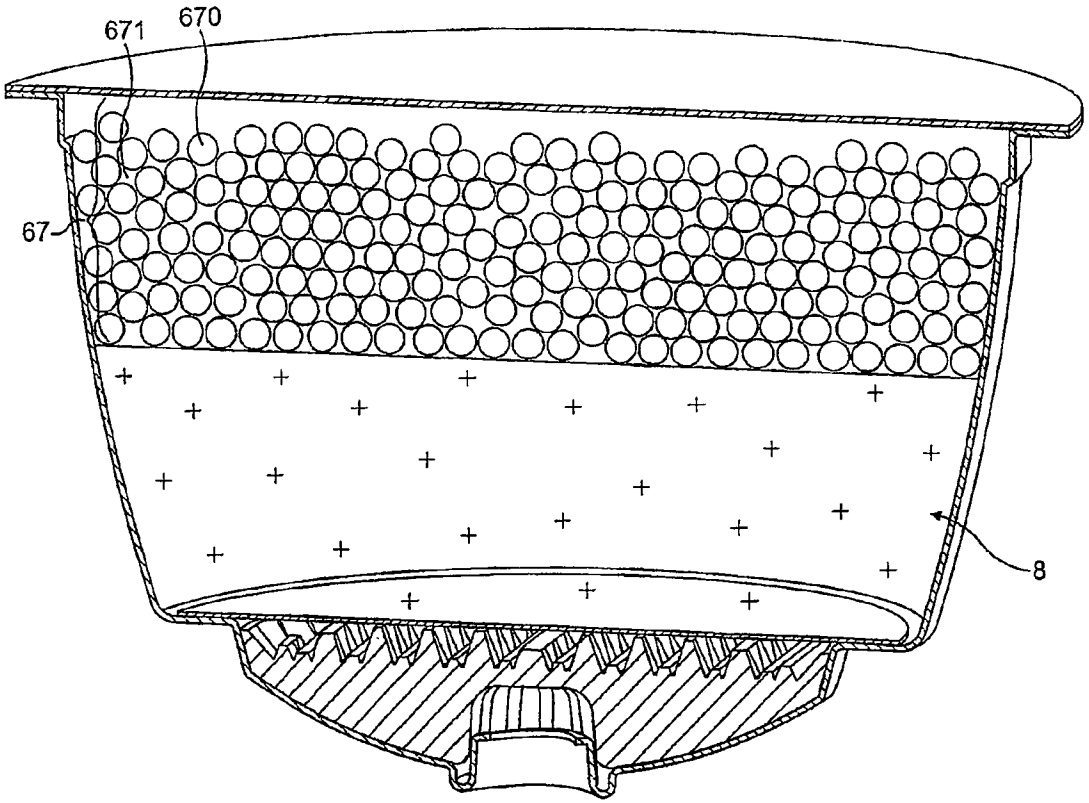
FIG. 15 shows a view in section on a vertical mid-plane of another embodiment of a capsule according to the invention.

In another possible embodiment depicted in FIG. 15, the means for breaking the jet and distributing the fluid across the bed of substance may comprise a layer 67 which separates the entry of the jet of fluid from the surface of the bed of substance, which layer 67 comprises a plurality of macroscopic elements 670 such as beads, granules or sticks or other equivalent elements. These elements 670 are preferably in a material of a density lower than the density of the substance 18 contained in the capsule and/or the layer 67 has a mass per unit volume lower than the mass per unit volume of the bed of substance so that the elements remain on the surface of the bed of substance under dry conditions and under the hydraulic conditions of extraction. These may be elements made of expanded plastic or cellulose for example. The elements occupy all or some of the volume between the jet of fluid entering the capsule and the surface of the bed of substance while at the same time freeing up a network of gaps 671 between each contiguous element 670 for the passage of the fluid through the layer 67 at a speed that is reduced by comparison with the initial speed of the jet of fluid leaving the injection means. The elements are preferably made of food-grade material and are preferably inert under the heat, pressure and humidity conditions of extraction and under the conditions of storage in contact with the food substance. The size of the elements may vary and be of the order of 1 to 8 mm approximately, preferably 2.5 to 6 mm. These elements prevent the jet from striking the surface of the bed of substance 18 directly and thus create a multitude of small empty spaces able to produce a flow network for the fluid entering the bed of substance. They are preferably made of food grade plastic such as polypropylene, polystyrene or some other appropriate material.

The invention also relates to a system for producing and delivering a plurality of drinks by injecting a pressurized fluid into capsules comprising an injection device of the type illustrated in FIG. 9 or alternatively described and featured in detail in the co-pending European application EP No. 03019163.9 entitled: "Food preparation method". The injection device thus produces at least one jet of pressurized fluid in the said capsules. An assortment of first and second capsules is provided in the system, these being configured to be combined with the injection device. Each capsule in the assortment thus comprises a body and an injection wall, a chamber containing at least one food substance, means for retaining the internal pressure in the said chamber. The first capsules are of the type of those described in this application, that is to say that they comprise, in addition to the general means thus defined, means configured to break the jet of fluid injected and to split the flow as the fluid passes through the substance so as to reduce or eliminate the stirring-up of the substance in the chamber. The second capsules are, for their part, configured in the same general manner but without the said means 6, 60, 62 so as to encourage, unlike the said first capsules, a certain stirring-up of the substance in the chamber of the second capsules. Capsules not employing these means for breaking the jet of fluid are thus described and illustrated in detail in patent application WO 03/059778, for example, which application is inserted here by reference.

The present invention is not restricted to the embodiments strictly described and illustrated but includes any technical equivalent that falls within the scope of the claims that follow.

The invention claimed is:

1. A capsule for delivering a drink by injecting a pressurized fluid into the capsule comprising:

a hollow body and an injection wall attached to the body;

an injection space allowing an injection means in the form of at least one jet of pressurized fluid to be introduced through the injection wall;

a chamber defined by the body and containing a bed of at least one food substance to be extracted;

means for retaining an internal pressure in the chamber; and means for impacting the jet of fluid so as to reduce a speed of the jet of fluid injected into the capsule and distribute the fluid across the bed of substance at a reduced speed, wherein the means for impacting the jet of fluid comprises (i) at least one wall that separates the injection space from the chamber, and (ii) a multitude of openings passing through the wall in such a way as to distribute the flow of fluid across the bed of substance.

2. The capsule according to claim 1, wherein the wall comprises welding edges which are welded against an internal surface of the hollow body in such a way as to position the wall back from the injection wall.

3. The capsule according to claim 2, wherein the wall is a deformable flexible film.

4. The capsule according to claim 1, wherein the wall of the means for impacting the jet of fluid is at an orientation selected from the group consisting of substantially parallel to, convex and concave with respect to the injection wall.

5. The capsule according to claim 1, wherein the openings of the perforated wall are distributed substantially uniformly across the wall so as to distribute the stream of fluid substantially uniformly across the bed of substance.

6. The capsule according to claim 1, wherein the perforated wall is selected from the group consisting of a plastic wall with holes, a film with holes, a grating, a layer of woven or nonwoven material, a porous layer and combinations thereof.

7. The capsule according to claim 3, wherein the food substance to be extracted substantially occupies an entire interior of the chamber and the perforated wall is immobilized a distance of 1 mm or less away from the surface of the bed.

8. The capsule according to claim 7, wherein the perforated wall is in contact with the surface of the bed of substance in the chamber.

9. The capsule according to claim 8, wherein the perforated wall is positioned so as to keep the bed of substance in a compression state.

10. The capsule according to claim 1, wherein the wall of the means for impacting the jet of fluid is rigid.

11. The capsule according to claim 10, wherein the wall of the means for impacting the jet of fluid forms a bottom of a dish which is inserted inside the body.

12. The capsule according to claim 1, wherein the means for impacting the jet of fluid comprise a layer of material which separates the fluid jet inlet from the surface of the bed of the substance.

13. The capsule according to claim 12, wherein the layer is in a form selected from the group consisting of beads, granules and sticks.

14. Capsule according to claim 1, wherein the pressure-retaining means comprise:

a puncturable membrane, raised elements which open the membrane in order to create punctures and allow the liquid extract to pass through the punctures, the punctures in the membrane being created due to an effect of the rise in pressure in the chamber of the capsule.

15. Capsule according to claim 14, wherein the raised elements are positioned on the outside of the chamber.

16. Capsule according to claim 14, wherein the raised elements are positioned on the inside of the chamber.

17. Capsule according to claim 14, wherein the raised elements are distributed over a plate which comprises ducts leading to openings through which the drink can flow.

18. Capsule according to claim 14, wherein the raised elements have a shape selected from the group consisting of pyramids, cone frustums, domes, elongate ribs, spikes and blades.

19. Capsule according to claim 1, wherein the retaining means comprise:

a filter wall comprising pre-formed openings or points of weakness.

20. Capsule according to claim 1, wherein the body comprises a collector for a drink and at least one passage for dispensing the drink.

21. Capsule according to claim 20, wherein the collector comprises drink overflow means bordering the passage so as to slow a stream of drink leaving the capsule.

22. Capsule according to claim 1, wherein the food substance contains ground coffee or tea.

23. A capsule comprising:

a hollow body and an injection wall attached to the body;

an injection space allowing an injection means in the form of at least one jet of pressurized fluid to be introduced through the injection wall;

a chamber defined by the body and containing a food substance to be extracted;

a member located so as to reduce the speed of the jet of fluid injected into the capsule and distribute the fluid across the bed of substance at a reduced speed, wherein the member comprises (i) at least one wall that separates the injection space from the chamber, and (ii) a multitude of openings passing through the wall in such a way as to distribute the flow of fluid across the bed of substance.

* * * * *